US010879677B2

(12) United States Patent
Dal Re et al.

(10) Patent No.: US 10,879,677 B2
(45) Date of Patent: Dec. 29, 2020

(54) SHAPED COLLET FOR ELECTRICAL STRESS GRADING IN CORONA IGNITION SYSTEMS

(71) Applicant: Tenneco Inc., Lake Forest, IL (US)

(72) Inventors: Massimo Dal Re, Concordia Sulla Secchia (IT); Giovanni Betti Beneventi, Modena (IT); Giulio Milan, Modena (IT); Stefano Papi, Modena (IT); Alessio Di Giuseppe, San Benedetto del Tronto (IT)

(73) Assignee: Tenneco Inc., Lake Forest, IL (US)

( * ) Notice: Subject to any disclaimer, the term of this patent is extended or adjusted under 35 U.S.C. 154(b) by 76 days.

(21) Appl. No.: 16/239,224

(22) Filed: Jan. 3, 2019

(65) Prior Publication Data

US 2019/0214796 A1 Jul. 11, 2019

Related U.S. Application Data

(60) Provisional application No. 62/613,518, filed on Jan. 4, 2018.

(51) Int. Cl.

| | |
|---|---|
| ***H01T 19/00*** | (2006.01) |
| ***H01T 13/50*** | (2006.01) |
| ***H01T 21/02*** | (2006.01) |
| ***H01T 13/36*** | (2006.01) |
| ***H01T 13/38*** | (2006.01) |
| *H01T 13/44* | (2006.01) |

(52) U.S. Cl.

CPC ..... *H01T 19/00* (2013.01); *H01T 13/36* (2013.01); *H01T 13/38* (2013.01); *H01T 13/50* (2013.01); *H01T 21/02* (2013.01); *H01T 13/44* (2013.01)

(58) Field of Classification Search

CPC ..... H01T 19/00; H01T 13/38; H01T 13/50; H01T 13/44; H01T 21/02; H01T 13/36

USPC ..... 123/143 B

See application file for complete search history.

(56) References Cited

U.S. PATENT DOCUMENTS 2,902,747 A * 9/1959 Reiter ..... H01T 13/36 445/7

3,883,762 A * 5/1975 Harris ..... H01T 13/52 313/130

4,490,122 A * 12/1984 Tromeur ..... H01T 13/54 313/141

(Continued)

OTHER PUBLICATIONS

International Search Report, dated Mar. 29, 2019 (PCT/US2019/012244).

*Primary Examiner* — Mahmoud Gimie

(74) *Attorney, Agent, or Firm* — Robert L. Stearns; Dickinson Wright, PLLC

(57) ABSTRACT

A corona igniter assembly which is designed to reduce the amount of air gaps between insulating components and thus reduce electrical fields concentrated in those air gaps and the associated unwanted corona discharge. The assembly includes a high voltage center electrode surrounded by a ceramic insulator and a high voltage insulator. A dielectric compliant insulator is disposed between the ceramic insulator and the high voltage insulator. A layer of metal is applied to at least one of the insulators, for example the ceramic insulator. A compliant collet formed of a partially resistive material covers a sharp edge of the layer of metal to reduce the electric field and smooth the electric field distribution at the sharp edge of the metal layer.

17 Claims, 6 Drawing Sheets

(56) References Cited

U.S. PATENT DOCUMENTS

| | | | | |
|---|---|---|---|---|
| 4,841,409 | A * | 6/1989 | Kalwar | H01T 19/00 250/324 |
| 8,742,652 | B2 | 6/2014 | Niessner | |
| 8,767,372 | B2 | 7/2014 | Stifel et al. | |
| 9,065,256 | B2 | 6/2015 | Makarov et al. | |
| 9,553,427 | B2 | 1/2017 | Achtstätter et al. | |
| 9,644,598 | B2 | 5/2017 | Achtstätter et al. | |
| 10,211,605 | B2 * | 2/2019 | Subramanian | H01T 13/08 |
| 2009/0033194 | A1 * | 2/2009 | Jaffrezic | H01T 13/34 313/130 |
| 2012/0192824 | A1 | 8/2012 | Burrows et al. | |
| 2013/0199484 | A1 * | 8/2013 | Stifel | H01T 13/50 123/143 B |
| 2015/0114332 | A1 * | 4/2015 | Stifel | H01T 13/54 123/143 B |
| 2016/0049773 | A1 | 2/2016 | Stifel et al. | |
| 2017/0025824 | A1 | 1/2017 | Mixell et al. | |
| 2017/0149216 | A1 | 5/2017 | Stifel et al. | |

* cited by examiner

SHAPED COLLET FOR ELECTRICAL STRESS GRADING IN CORONA IGNITION SYSTEMS

CROSS-REFERENCE TO RELATED APPLICATIONS

This U.S. utility application claims priority to U.S. provisional patent application No. 62/613,518, filed Jan. 4, 2018, the entire contents of which is incorporated herein by reference in its entirety.

BACKGROUND OF THE INVENTION

1. Field of the Invention

This invention relates generally to corona ignition assemblies, and methods of manufacturing the corona ignition assemblies.

2. Related Art

Corona igniter assemblies for use in corona discharge ignition systems typically include an ignition coil assembly attached to a firing end assembly as a single component. The firing end assembly includes a central electrode charged to a high radio frequency voltage potential, creating a strong radio frequency electric field in a combustion chamber. The electric field causes a portion of a mixture of fuel and air in the combustion chamber to ionize thus facilitating combustion of the fuel-air mixture. The electric field is preferably controlled so that the fuel-air mixture maintains insulating properties and corona discharge occurs, also referred to as non-thermal plasma. The ionized portion of the fuel-air mixture forms a flame front which then becomes self-sustaining and combusts the remaining portion of the fuel-air mixture. The electric field is also preferably controlled so that the fuel-air mixture does not lose all insulating properties, which would create thermal plasma and an electric arc between the electrode and grounded cylinder walls, piston, or other portion of the igniter.

Ideally, the electric field is also controlled so that the corona discharge only occurs at the firing end and not along other portions of the corona igniter assembly. However, such control is oftentimes difficult to achieve due to air gaps located between the components of the corona igniter assembly where unwanted corona discharge can occur. For example, although the use of multiple insulators formed of several materials provides improved efficiency, robustness, and overall performance, the metallic shielding and the different electrical properties between the insulator materials leads to an uneven electrical field and air gaps at the interfaces. The dissimilar coefficients of thermal expansion and creep between the insulator materials can also lead to air gaps at the interfaces. During use of the corona igniter, the electrical field tends to concentrate in those air gaps, leading to unwanted corona discharge. Such corona discharge can cause material degradation and hinder the performance of the corona igniter assembly.

SUMMARY OF THE INVENTION

One aspect of the invention provides a corona igniter assembly. The corona igniter assembly comprises a high voltage center electrode surrounded by a ceramic insulator and a high voltage insulator. The ceramic insulator is formed of a ceramic material, and the high voltage insulator is formed of a material different from the ceramic material. A dielectric compliant insulator is disposed between the ceramic insulator and the high voltage insulator. A layer of metal extends between opposite edges and is applied to at least one of the insulators. A compliant collet formed of a partially resistive material covers one of the edges of the layer of metal.

Another aspect of the invention provides a method of manufacturing a corona igniter assembly. The method comprises the steps of: providing a ceramic insulator formed of a ceramic material, a high voltage insulator formed of a material different from the ceramic material, and a dielectric compliant insulator; and applying a layer of metal to at least one of the insulators. The method also includes disposing a high voltage center electrode in a bore of the ceramic insulator, a bore of the dielectric compliant insulator, and a bore of the high voltage insulator; and disposing a compliant collet formed of a partially resistive material over one of the edges of the layer of metal.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF EXAMPLE EMBODIMENTS

Figure 1:
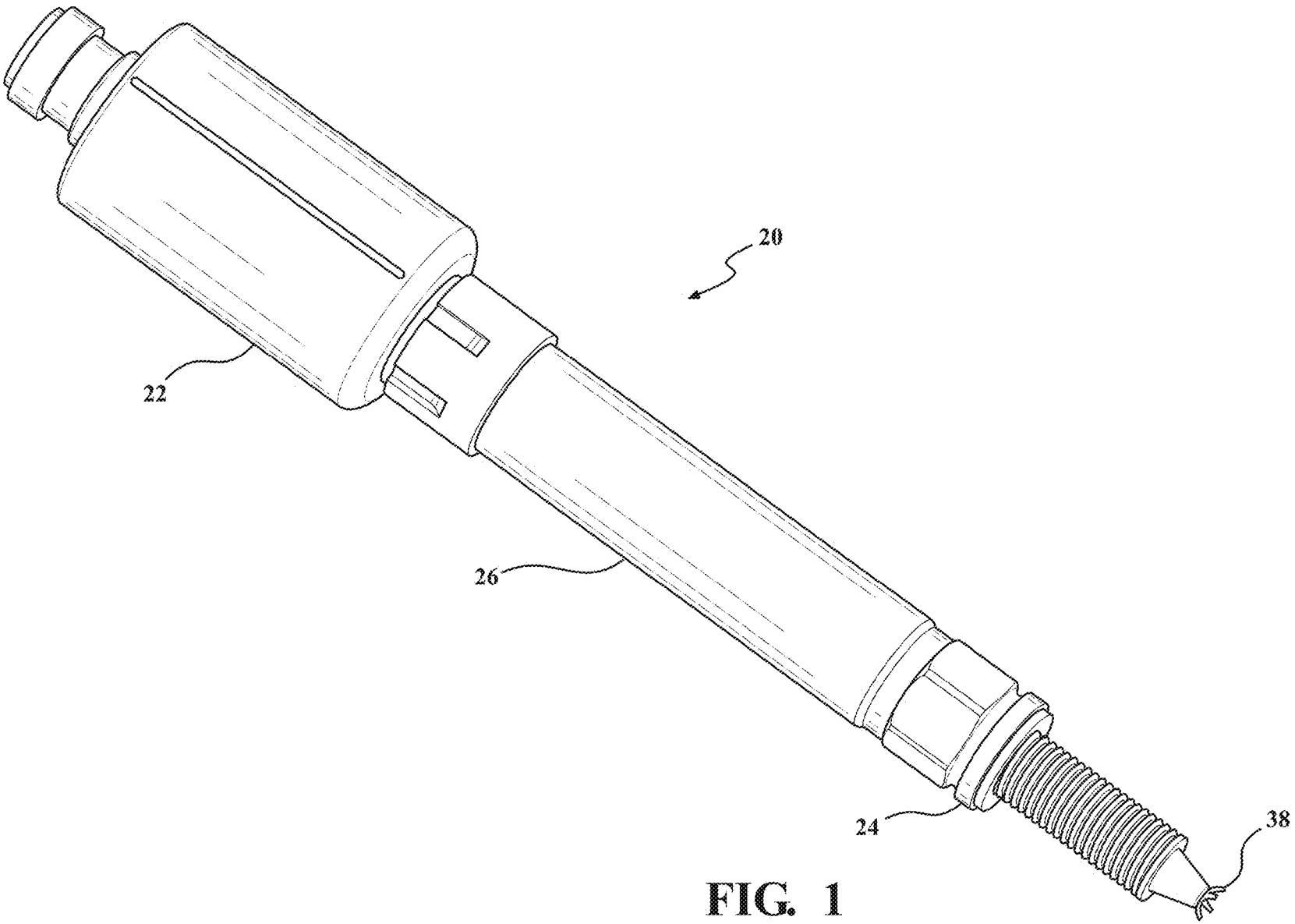
FIG. 1 is a perspective view of a corona igniter assembly in an assembled position according to one exemplary embodiment of the invention.

A corona igniter assembly 20 for receiving a high radio frequency voltage and applying a radio frequency electric field in a combustion chamber containing a mixture of fuel and gas to provide a corona discharge is generally shown in FIG. 1. The corona igniter assembly 20 includes an ignition coil assembly 22, a firing end assembly 24, and a metal tube 26 surrounding and coupling the ignition coil assembly 22 to the firing end assembly 24. The corona igniter assembly 20 also includes a high voltage insulator 28 and at least one dielectric compliant insulator 30 each disposed between the ignition coil assembly 22 and a ceramic insulator 32 of the firing end assembly 24, inside of the metal tube 26.

The ignition coil assembly 22 typically includes a plurality of windings (not shown) receiving energy from a power source (not shown) and generating the radio frequency high voltage electric field. According to the example embodiment shown in the Figures, the ignition coil assembly 22 extends along a center axis and includes a coil output member for transferring energy toward the firing end assembly 24.

The firing end assembly 24 is a corona igniter, as shown in the Figures, for receiving the energy from the ignition coil assembly 22 and applying the radio frequency electric field in the combustion chamber to ignite the mixture of fuel and air. The corona igniter 24 includes an igniter central electrode 34, a metal shell 36, and the ceramic insulator 32. The ceramic insulator 32 includes an insulator bore receiving the igniter central electrode 34 and spacing the igniter central electrode 34 from the metal shell 36.

The igniter central electrode 34 of the firing end assembly 24 extends longitudinally along the center axis from a terminal end to a firing end. An electrical terminal can be disposed on the terminal end, and a crown 38 is disposed on the firing end of the igniter central electrode 34. The crown 38 includes a plurality of branches extending radially outwardly relative to the center axis for applying the radio frequency electric field and forming a robust corona discharge.

The ceramic insulator 32, also referred to as a firing end insulator 32, includes a bore receiving the igniter central electrode 34 and can be formed of several different ceramic materials which are capable of withstanding the operating conditions in the combustion chamber. In one exemplary embodiment, the ceramic insulator 32 is formed of alumina. The material used to form the ceramic insulator 32 also has a high capacitance which drives the power requirements for the corona igniter assembly 20 and therefore should be kept as small as possible. The ceramic insulator 32 extends along the center axis from a ceramic end wall to a ceramic firing end adjacent the firing end of the igniter central electrode 34. The metal shell 36 surrounds the ceramic insulator 32, and the crown 38 is typically disposed outwardly of the ceramic firing end.

Figure 2:
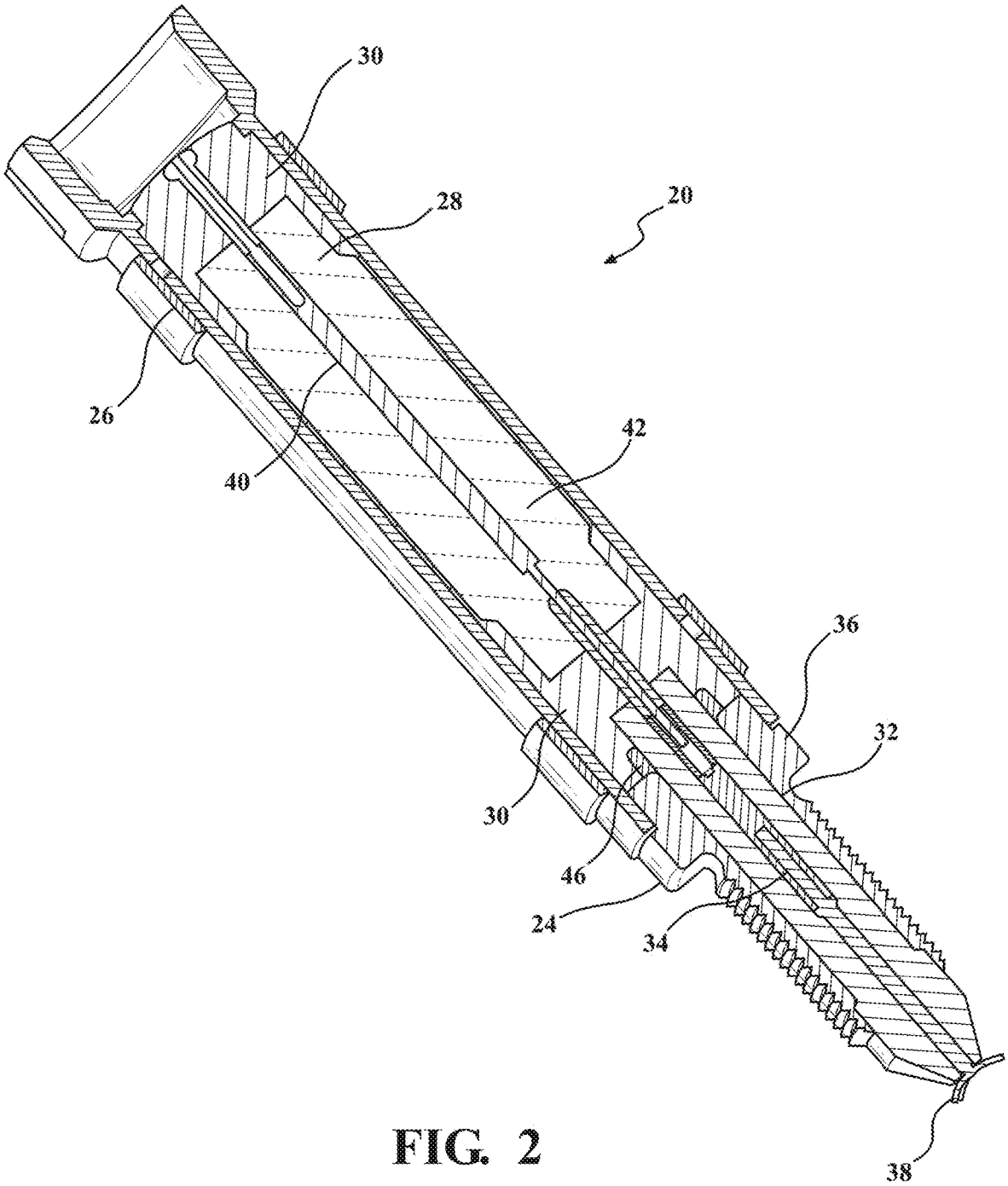
FIGS. 2-7 are sectional views of the corona igniter assembly of FIG. 1 showing a compliant collet according to an exemplary embodiment.
Figure 3:
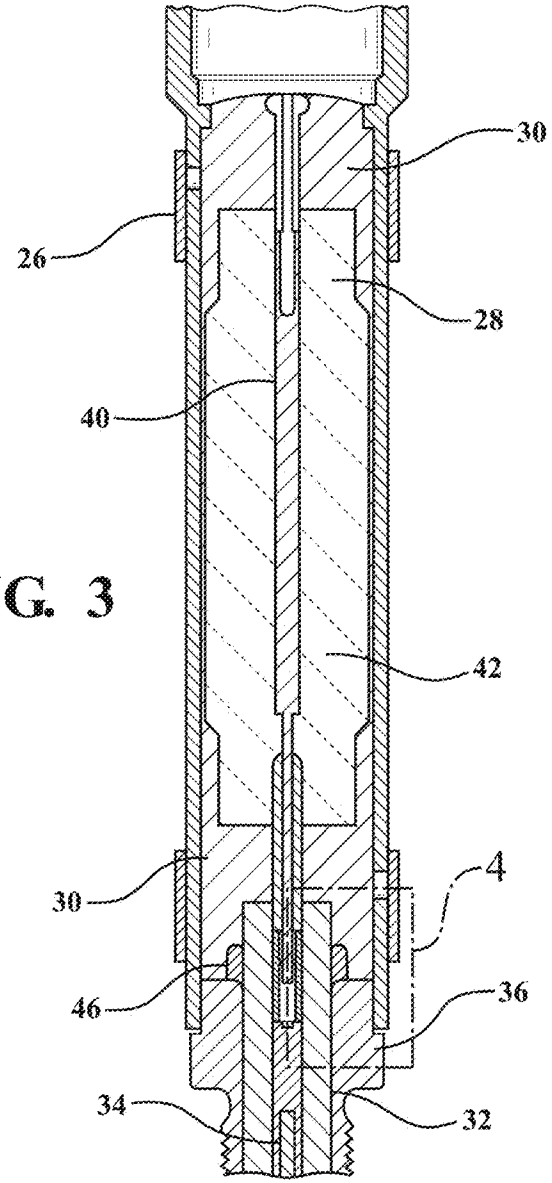
Figure 5:
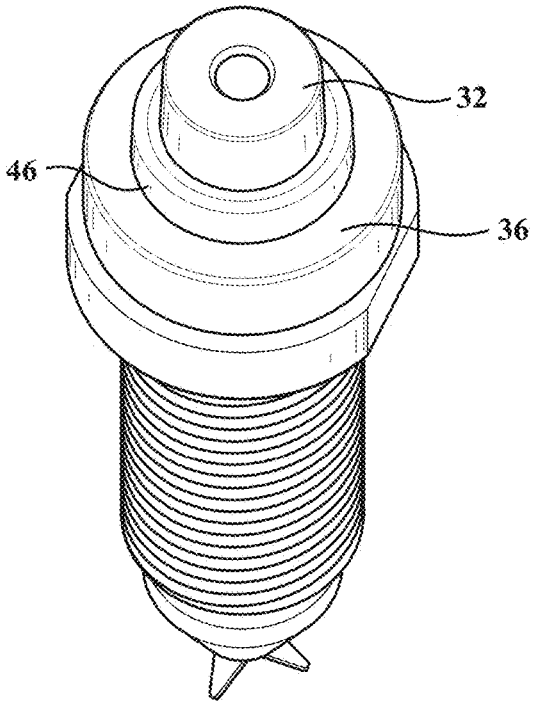

The corona igniter assembly 20 also includes a high voltage central electrode 40 received in the bore of the ceramic insulator 32 and extending to the coil output member, as shown in FIGS. 2 and 3. The electrical signal is carried by high voltage central electrode 40 (metallic rod).

A brass pack can be disposed in the bore of the ceramic insulator 32 to electrically connect the high voltage central electrode 40 and the electrical terminal. In addition, the high voltage central electrode 40 is preferably able to float along the bore of the high voltage insulator 28. Thus, a spring or another axially complaint member can be disposed between the brass pack and the high voltage central electrode 40. Alternatively, the spring could be located between the high voltage central electrode 40 and the coil output member.

In the example embodiments, the high voltage insulator 28 extends between an HV insulator upper wall coupled to a second dielectric compliant insulator 30 and an HV insulator lower wall coupled to the dielectric compliant insulator 30. The high voltage insulator 28 preferably fills the length and volume of the metal tube 26 located between the dielectric compliant insulators 30.

The high voltage insulator 28 is typically formed of an insulating material which is different from the ceramic insulator 32 of the firing end assembly 24 and different from the at least one dielectric compliant insulator 30. Typically, the high voltage insulator 28 has a coefficient of thermal expansion (CLTE) which is greater than the coefficient of thermal expansion (CLTE) of the ceramic insulator 32. This insulating material has electrical properties which keeps capacitance low and provides good efficiency. Table 1 lists preferred dielectric strength, dielectric constant, and dissipation factor ranges for the high voltage insulator 28; and Table 2 lists preferred thermal conductivity and coefficient of thermal expansion (CLTE) ranges for the high voltage insulator 28. In the exemplary embodiment, the high voltage insulator 28 is formed of a fluoropolymer, such as polytetrafluoroethylene (PTFE). The high voltage insulator 28 could alternatively be formed of other materials having electrical properties within the ranges of Table 1 and thermal properties within the ranges of Table 2.

TABLE 1

| Parameter | Value | U.M. | Testing conditions |
|---|---|---|---|
| Dielectric strength | >30 | kV/mm | −40° C., +150° C. |
| Dielectric constant | ≤2.5 | | 1 MHz; −40° C., +150° C. |
| Dissipation factor | <0.001 | | 1 MHz −40° C., +150° C. |

TABLE 2

| | | | |
|---|---|---|---|
| Thermal conductivity | >0.8 | W/m/K | 25° C. |
| CLTE | <35 | ppm/K | −40° C., +150° C. |

The corona igniter assembly 20 includes three materials as electrical insulators between the central high voltage central electrode 40 and the external shielding (metal tube) 26. In the exemplary embodiments, the dielectric compliant insulator 30 is compressed between the high voltage insulator 28 and the ceramic insulator 32. The dielectric compliant insulator 30 provides an axial compliance which compensates for the differences in coefficients of thermal expansion between the high voltage insulator 28, typically formed of fluoropolymer, and the ceramic insulator 32. Preferably, the hardness of the dielectric compliant insulator 30 ranges from 40 to 80 (shore A). The compression force applied to the dielectric compliant insulator 30 is set by design to be within the elastic range of the chosen material, usually a rubber or silicone compound. Typically, the dielectric compliant insulator 30 is formed of rubber or a silicone compound, but could also be formed of silicone paste or injection molded silicone.

As indicated above, the corona ignition system is realized by the coil producing the high frequency and high voltage electric field (E-field) and the firing end assembly 24 applying this E-field in the combustion chamber for fuel ignition. The E-field loads and unloads the capacitance between the high voltage central electrode 40 of the extension cable connecting the coil, the firing end assembly 24, and the external metal tube 26. This behavior implies that all the materials in the assembly impact the electrical performances of the system. If any layer or gap of air is left between the high voltage central electrode 40 and the external metal tube 26 (which is the closest ground plane), it is very likely that the corona inception voltage will be reached in those areas. If corona is formed within the igniter assembly 20, sensible performance losses and increased risk of discharge can be observed.

It been found that the electric field concentrated at the interface of the different insulators 28, 30, 32 and the high voltage central electrode 62 is high, and typically higher than the voltage required for inception of corona discharge. Thus, the corona igniter assembly 20 can optionally include a semi-conductive sleeve 42 surrounding a portion of the high voltage central electrode 40 to dampen the peak electric field and fill air gaps along the high voltage central electrode 40. The high voltage central electrode 40 can be covered with the semiconductive sleeve 42. The semiconductive sleeve 42 typically extends axially from the upper HV connection (coil side or coil output member) to the brass pack inside the bore of the ceramic insulator 32.

The semiconductive sleeve 42 can also extend continuously, uninterrupted, along the interfaces between the different insulators 28, 30, 32. In an example embodiment, the semiconductive sleeve 42 is formed of a rubber material with a conductive filler, such as graphite or another carbon-based material. For example, silicone rubber can be used to form the semiconductive sleeve 42. It has been found that the semiconductive sleeve 42 behaves like a conductor at high voltage and high frequency (HV-HF). In one embodiment, the semiconductive sleeve 42 has an electrical conductivity higher than $10^{-2}$ S/m.

To avoid air gaps during assembly or operation of the corona igniter assembly 20, a layer 44 formed of metal, also referred to as metallization, is applied to an outer surface of at least one of the insulators (diameters of the insulating materials). The layer of metal applied to the insulators, ceramic in particular, allows a bond between a metallic ground plane and the insulator, avoiding any gap formation during the assembly or operation.

The outer surface of the ceramic insulator metallized or coated with the metal layer 44 to inhibit (electrically) all the clearances between the insulator 32 itself and the metal shell 36. The ceramic insulator 32, generally adopted in spark plug technology, withstands the operating conditions in the combustion chamber but has very high capacitance that drives power requirements for the system and, therefore, has to be kept the smallest possible of the insulators, which can lead to the clearances.

As a drawback, the termination of the metallization layer 44 which is usually very thin, is a sharp edge where the E-field concentrates to the point that it could be higher than the corona inception voltage or the dielectric strength of the surrounding materials. The height 44A of the sharp edge is shown in FIG. 4.

To reduce the electric field and smooth the electric field distribution at the sharp edge of the metal layer 44, a compliant semiconductive or metallic collet 46 or bead covers the metallization end to help reduce the electric field peak and the smooth electric field distribution. The compliant collet 46 is formed of a weakly-conductive or partially resistive material. The compliant collet 46 can be made of a single material, with homogeneous or inhomogeneous, isotropic or anisotropic electrical conductivity, which can or cannot be E-field dependent, or the compliant collet 46 can be made of layers of two or more different semiconductive or conductive materials, with the material closer to the sharp edge (metallization end) having the higher electrical conductivity. In the case of the single material embodiment, the averaged electrical conductivity of the compliant collet 46 must be higher than $10^{-2}$ S/m. In the case of the compliant collet 46 being formed of several materials, the averaged electrical conductivity of the material closer to the interface must be higher than $10^{-6}$ S/m, while the averaged electrical conductivity of the other materials must be included in the $10^{-6}$ to $10^{-2}$ S/m range.

As stated above, the electric field peak at the termination of the metallization layer 44 is very high and usually higher than the corona inception voltage. The semiconductive or metallic (or weakly-conductive or partially resistive) compliant collet 46 smoothes the electric field distribution at the interface of the sharp edge of the metal layer 44 and the surrounding area. In addition, the adhesion and overall compliancy at the interface is enhanced by the semiconductive or conductive compliant collet 46.

Figure 4:
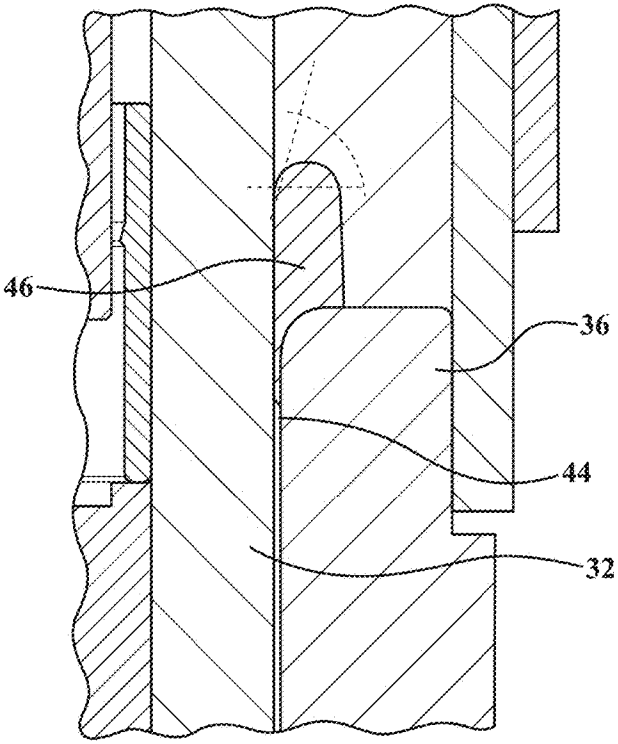
Figure 6:
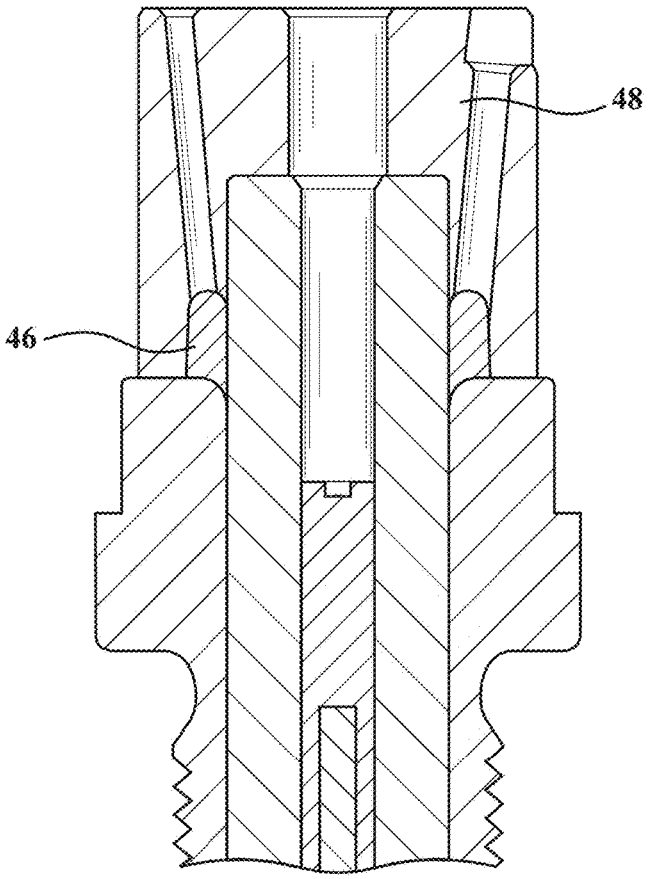
Figure 7:
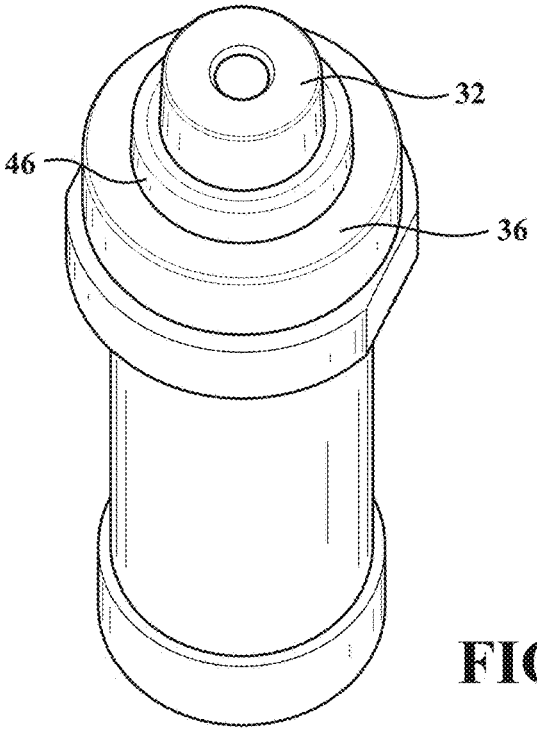
Figure 8:
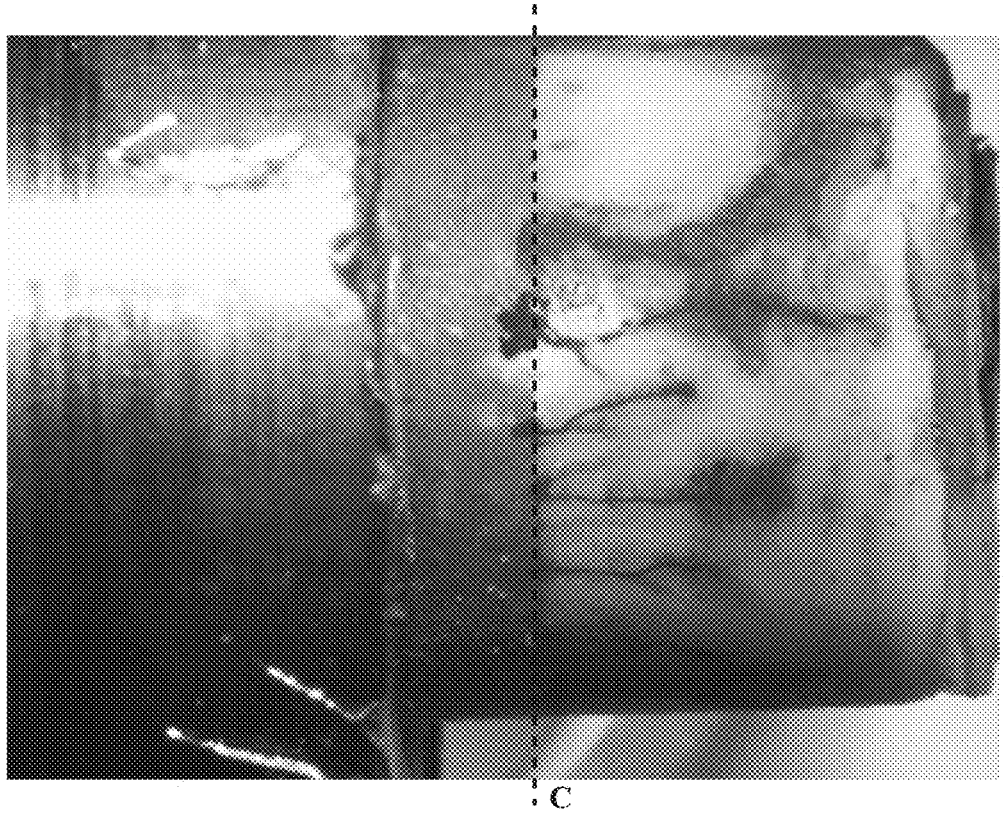
FIG. 8 illustrates a comparative assembly without the compliant collet.
Figure 9:
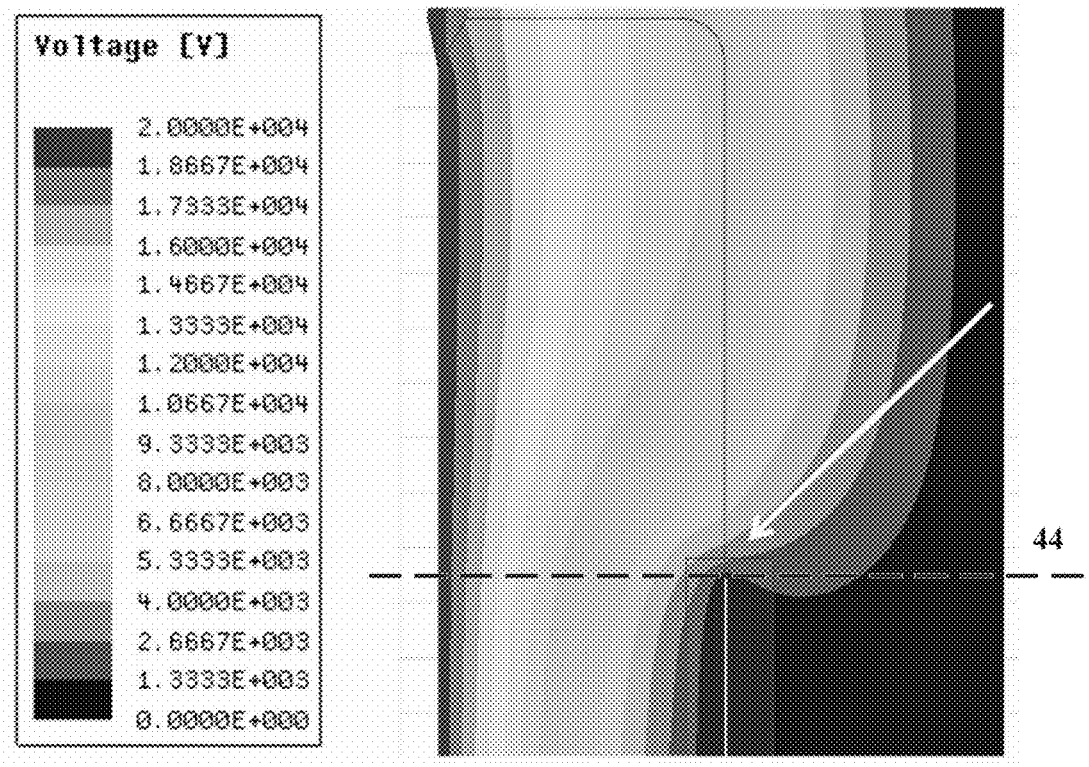
FIGS. 9 and 10 illustrate the electric field within the assembly according to example embodiments.

The semiconductive or conductive compliant collet 46 is applied at the termination of the metallization layer 44 and it provides a bridge from the dissimilar insulating materials (ceramic insulator 32 and silicone rubber dielectric compliant insulator 30) to the plug shell 36 that acts as the primary ground plane, as shown in FIG. 4. The shape of the semiconductive or conductive compliant collet 46 is engineered in such a way that the effect of E-field concentration on the sharp edges and terminations is minimized. Simulations were adopted to optimize the round shape of the semiconductive or conductive compliant collet 46, which is typically formed of rubber. The compliant collet 46, also referred to as a semi-conductive ring, can be over-molded on the plug assembly with a specific, partially-compliant, tool 48, as shown in FIG. 6.

According to an example embodiment, the compliant collet 46 is formed of a semiconductive or conductive silicone rubber, and thus is a similar material to the silicone rubber insulating material of the dielectric compliant insulator 30. The compliant collet 46 and the dielectric compliant insulator 30 preferably have good adhesion properties and similar thermal expansion coefficients. These features help avoiding the generation of air gaps at the interface between the insulating materials and the ground plane.

Figure 10:
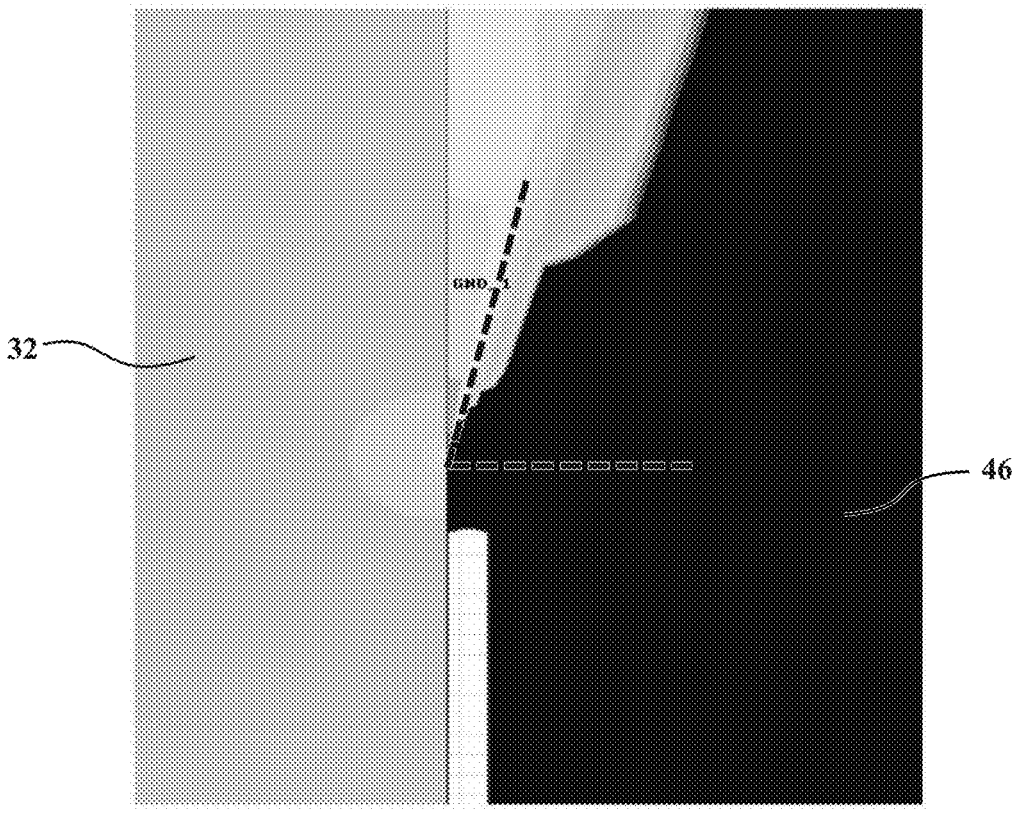

The mating angle β, see FIGS. 4 and 10, between the semiconductive or conductive compliant collet 46 and the ceramic insulator 32 has been optimized for the minimum peak electric field. For optimal performance, $45° \leq \beta < 90°$ and is only set by processability constraints. The mating angle β is the angle between a line perpendicular to the center axis of the corona igniter assembly 20 and a rounded top outer surface adjacent a flat inside surface of the compliant collet 46.

The final shape of the semiconductive or conductive compliant collet 46 can be obtained through a high precision dispensing system. The adoption of a mold and injection process can ensure the highest control on the final geometry of the compliant collet 46 (See FIG. 6).

The high voltage insulator 28 formed of the fluoropolymer, or a thermosetting epoxy, preferably fills the whole length of the extension located within the metal tube 26, from the ceramic insulator 32 and the dielectric compliant insulator 30 to the coil connection or coil output member. Such materials are adopted in alternative because their electrical properties keep the capacitance low, have good efficiency, or have compatible thermal expansion coefficients with the metal tube 26, i.e. extension shield.

Another aspect of the invention includes forming the corona igniter assembly 20 including the components and the compliant collet 46 described above.

Many modifications and variations of the present invention are possible in light of the above teachings and may be practiced otherwise than as specifically described while within the scope of the claims. It is also contemplated that all features of all claims and of all embodiments can be combined with each other, so long as such combinations would not contradict one another.

What is claimed is:

1. A corona igniter assembly comprising:

a high voltage center electrode surrounded by a ceramic insulator and a high voltage insulator, said ceramic insulator being formed of a ceramic material and said high voltage insulator being formed of a material different from said ceramic material;

a dielectric compliant insulator disposed between said ceramic insulator and said high voltage insulator;

a layer of metal extending between opposite edges and applied to at least said ceramic insulator; and a compliant collet formed of a partially resistive material disposed between said layer of metal along said ceramic insulator and said dielectric compliant insulator, and said compliant collet covering one of said edges of said layer of metal.

2. A corona igniter assembly according to claim 1, wherein said compliant collet is formed of silicone rubber.

3. A corona igniter assembly according to claim 1, wherein said one of said edges of said layer of metal covered by said compliant collet is sharp.

4. A corona igniter assembly according to claim 1, wherein said ceramic insulator is formed of a material including alumina, said high voltage insulator is formed of a material including polytetrafluoroethylene (PTFE) or epoxy having a coefficient of thermal expansion (CLTE) which is greater than a coefficient of thermal expansion (CLTE) of said ceramic insulator; and said dielectric compliant insulator is formed of rubber or a material including silicone.

5. A corona igniter assembly according to claim 1, wherein said compliant collet is formed of a single material with isotropic or anisotropic electrical conductivity.

6. A corona igniter assembly according to claim 5, wherein said single material of said compliant collet has an averaged electrical conductivity of higher than $10^{-2}$ S/m.

7. A corona igniter assembly according to claim 1, wherein said compliant collet is formed of layers of two or more different semiconductive or conductive materials.

8. A corona igniter assembly according to claim 7, wherein said compliant collet includes two semiconductive or conductive materials, a first one of said semiconductive or conductive materials is located closer to said one edge of said metal layer and has a higher electrical conductivity that a second one of said semiconductive or conductive materials.

9. A corona igniter assembly according to claim 8, wherein an averaged electrical conductivity of said first one of said semiconductive or conductive materials is higher than 10'S/m, and an averaged electrical conductivity of said second one of said semiconductive or conductive materials is in a range of $10^{-6}$ to 10'S/m.

10. A corona igniter assembly according to claim 1, wherein said dielectric compliant insulator is formed of silicone rubber.

11. A corona igniter assembly according to claim 1, wherein said compliant collet and said ceramic insulator present a mating angle therebetween which is at least 45° and less than 90°.

12. A corona igniter assembly according to claim 1, wherein said dielectric compliant member and said compliant collet are disposed between said high voltage insulator and said ceramic insulator.

13. A corona igniter assembly according to claim 1 including an igniter central electrode surrounded by said ceramic insulator and a metal shell surrounding said ceramic insulator; said igniter central electrode extending longitudinally along a center axis from a terminal end to a firing end and including a crown disposed on said firing end; and the crown including a plurality of branches extending radially outwardly relative to said center axis.

14. A corona igniter assembly according to claim 1, wherein said high voltage insulator is formed of a material having a dielectric strength of greater than 30 kV/mm, a dielectric constant of not greater than 2.5, and a dissipation factor of less than 0.001.

15. A corona igniter assembly according to claim 1, wherein said high voltage insulator is formed of a material having a thermal conductivity of greater than 0.8 W/mK at 25° C. and a coefficient of thermal expansion (CLTE) of less than 35 ppm/K at temperatures ranging from −40° C. to 150° C.

16. A corona igniter assembly according to claim 1, wherein said corona igniter assembly further includes:

an ignition coil assembly coupled to said high voltage center electrode;

a firing end assembly including an igniter central electrode coupled to said high voltage center electrode;

said firing end assembly including said ceramic insulator surrounding said igniter central electrode and a metal shell surrounding said ceramic insulator;

said igniter central electrode extending longitudinally along a center axis from a terminal end to a firing end and including a crown disposed on said firing end, said crown including a plurality of branches extending radially outwardly relative to said center axis;

said ceramic insulator being formed of a material including alumina;

said high voltage insulator being formed of polytetrafluoroethylene (PTFE) or thermosetting epoxy;

said dielectric compliant insulator being formed of rubber or a material including silicone;

said dielectric compliant insulator being compressed between said high voltage insulator and said ceramic insulator;

a sleeve formed of a material having an electrical conductivity higher than $10^{-2}$ S/m being disposed around said high voltage center electrode;

a second dielectric compliant insulator disposed between said high voltage insulator and said ignition coil assembly;

said one edge of said layer of metal being covered by said compliant collet includes a sharp edge;

said compliant collet is formed of silicone rubber; and said compliant collet and said ceramic insulator present a mating angle therebetween which is at least 45° and less than 90°.

17. A method of manufacturing a corona igniter assembly comprising the steps of:

providing a ceramic insulator formed of a ceramic material, a high voltage insulator formed of a material different from the ceramic material, and a dielectric compliant insulator;

applying a layer of metal to at least the ceramic insulator;

disposing a high voltage center electrode in a bore of the ceramic insulator, a bore of the dielectric compliant insulator, and a bore of the high voltage insulator; and disposing a compliant collet formed of a partially resistive material between the layer of metal along the ceramic insulator and the dielectric compliant insulator and over one of the edges of the layer of metal.

* * * * *